US006845529B2

(12) United States Patent
Berge

(10) Patent No.: US 6,845,529 B2
(45) Date of Patent: Jan. 25, 2005

(54) DISPOSABLE TRANSPORT MAT

(76) Inventor: Trygve Berge, 0022 Cove Blvd., Dillon, CO (US) 80435

( * ) Notice: Subject to any disclaimer, the term of this patent is extended or adjusted under 35 U.S.C. 154(b) by 0 days.

(21) Appl. No.: 10/382,952

(22) Filed: Mar. 5, 2003

(65) Prior Publication Data

US 2004/0172751 A1 Sep. 9, 2004

(51) Int. Cl.[7] ..... A61G 7/08
(52) U.S. Cl. ..... 5/81.1 HS; 5/81 C
(58) Field of Search ..... 5/81.1 HS, 81.1 C, 5/81.1 T, 81.1 R, 482

(56) References Cited

U.S. PATENT DOCUMENTS

| | | | | |
|---|---|---|---|---|
| 1,795,435 A | | 3/1931 | Melzer | |
| 3,284,816 A | | 11/1966 | Laubsch | 5/81 |
| 3,765,040 A | * | 10/1973 | Holstein | 5/487 |
| 3,829,914 A | | 8/1974 | Treat | 5/81 |
| 3,849,813 A | | 11/1974 | Neilson | 5/334 |
| 4,051,565 A | | 10/1977 | Berge | 5/81 |
| 4,944,053 A | * | 7/1990 | Smith | 5/81.1 |
| D346,346 S | | 4/1994 | Johnson et al. | D12/128 |
| 5,327,597 A | | 7/1994 | Rothbard | 5/481 |
| 5,638,586 A | | 6/1997 | Malin et al. | 24/587 |
| 5,638,588 A | | 6/1997 | Jungkind | 24/68 |
| 6,012,183 A | * | 1/2000 | Brooke et al. | 5/81.1 HS |
| D445,286 S | | 7/2001 | Rhyne | D6/610 |

FOREIGN PATENT DOCUMENTS

| | | | |
|---|---|---|---|
| GB | 2159047 | * 11/1985 | 5/81.1 HS |

OTHER PUBLICATIONS

Selected pages from website http://www.slidemat.com/Pages/applications.html, 2 pages total.
Transcription of video found on website; http://www.slidemat.com/Pages/vidwin.html 1 page total.

* cited by examiner

*Primary Examiner*—Alexander Grosz
(74) *Attorney, Agent, or Firm*—Sheridan Ross P.C.

(57) ABSTRACT

A disposable transport mat includes inner and outer panels which are joined to one another forming a tubular or loop shaped structure. Both panels are made of materials such as Tyvek®. The panels may be assembled to one another as by sewing or gluing. Padding may be provided as a layer between the inner and outer panels. A thin film may be applied to the outer panel to increase frictional engagement with a patient thereby assisting in uniform rolling motion of the transport mat during use. A cover may be used in conjunction with the transport mat to provide additional options in transporting or lifting a patient. The cover may incorporate a plurality of webbing strips with integral grasping loops.

13 Claims, 3 Drawing Sheets

DISPOSABLE TRANSPORT MAT

FIELD OF THE INVENTION

This invention relates to a disposable transport mat which may be used to reposition an article or person from one location to an adjacent location, more particularly, this invention relates to a disposable transport mat which allows a patient to be moved from one location to another without having to pick up the patient or roll the patient.

BACKGROUND OF THE INVENTION

Patients who have sustained a neck or back injury must be handled by medical personnel very carefully so that movement of the patient does not worsen the patient's condition by further traumatizing the patient's spinal cord. It is well understood that even the slightest movement of the patient which results in additional trauma placed on the spinal cord can cause paralysis or other problems which may not have been present if the patient was more carefully moved or transported. From the scene of an accident to the hospital, the patient must be moved at least twice including once from the location of the injury to a stretcher or ambulance bed, and then from the structure/ambulance bed to a hospital bed. Even for patients who have been previously admitted to a hospital for treatment of injuries, it is often necessary to move patients for surgery or other purposes. Therefore, even after receiving medical treatment, patients in a hospital are often moved a number of times. For those patients who have neck or back injuries, it is critical that the patients not be moved so that the spinal cord does not receive any additional injury.

The owner of the present invention is also the owner of a device known as the "Slide-Mat®" which is a transport mat for providing the capability to transport or move a patient from one location to another as described above. The Slide-Mat® is also disclosed in the U.S. Pat. No. 4,051,565 which is hereby incorporated by reference. The Slide-Mat ® is characterized by a tubular sewn arrangement of fabric including padding which fills the gap between the inner and outer surfaces. The inside fabric forming the interior surface is made of a very slippery fabric such as silicone coated rip-stop nylon. The outer fabric forming the outside surface is made of a separate piece of fabric such as nylon and a coating of HT Teflon™. The HT teflon improves water repelliency. The padding may be polyester. In use of the Slide-Mat®, one longitudinal edge of the Slide-Mat® is slid underneath one edge of the patient's body. Depending upon the extent of the patient's injuries, the patient can be gently lifted to partially raise one side of the patient's body in order so that the longitudinal edge may be placed underneath at least one side of the patient's body. If the patient cannot be lifted at all, then the longitudinal edge is slid to the extent possible under the one side of the patient's body. The patient is then pushed in a direction parallel to the plane in which the patient lies so that the Slide-Mat® rolls thereby shifting the patient transversely with respect to the direction in which the patient lies.

The Slide-Mat® has proven to be a very effective yet simple device for allowing a patient to be moved from one surface to another. The interior surface made of the silicone coated rip-stop nylon allows the interior surface to make contact during rolling of the Slide-Mat® without binding or folding thereby ensuring a smooth rolling movement of the device during use.

While the existing Slide-Mat® has many advantages and continues to provide an effective means of transporting a patient from one surface to another, the present invention has a number of additional advantages.

It is one object of the present invention to provide a transport mat which is disposable but is made of a material which has the equivalent strength as the original Slide-Mat® material.

It is another object to provide a transport mat that may be assembled by means in addition to sewing such as glueing of the edges which define the longitudinal and transverse edges of the Slide-Mat®, as well as the seam which is incorporated to join the ends of the pieces of material.

It is yet another object of the present invention to provide increased friction on the exterior surface of the Slide-Mat® thereby ensuring that the transport mat uniformly rolls and does not bunch up as a patient is moved.

In accordance with the present invention, a disposable transport mat is provided which includes a number of characteristics or features which improve upon the original Slide-Mat® product and the invention shown in the prior U.S. Pat. No. 4,051,565.

SUMMARY OF THE INVENTION

One of the advantages of the present invention is the use of a coating constituting a thin film or layer which is placed over the outer or exterior surface of the transport mat in order to enhance frictional engagement of the outer surface of the transport mat to the patient's body thereby also enhancing the ability of the transport mat to roll or rotate without bunching. The thin film or layer may be an adhesive spray which is applied uniformly and evenly across the outer surface.

Another improvement incorporated within the present invention is the use of Tyvek® spunbonded olefin material as opposed to fabric which not only reduces the cost of material, but also provides other options for assembling the transport mat. Tyvek® is a material which can be sewn like fabric, but is also easily glued in order to join two panels or sections of the Tyvek® material. Some types of Tyvek® such as the soft structure types may also be heat sealed or ultrasonically sealed. Tyvek® has high strength and is difficult to rip or tear. Tyvek® spunbonded olefin is made from high density polyethylene fibers and is manufactured and sold by Dupont®.

Manufacturing is further simplified because both the inner and outer panels or surfaces of the transport mat may be made of the Tyvek® material. Tyvek® has a slick surface; therefore, silicone spray is not required to provide necessary slickness of the interior surface. Nonetheless, Tyvek® also readily accepts spray coatings of all types. Therefore, the inner surfaces may still be sprayed with silicon as desired, and the outer surfaces may be sprayed or coated with a thin film to increase frictional engagement. For the inner panel, one particularly suitable style or type of Tyvek® which may be used is Tyvek®1025D. For the outer panel, one particularly suitable style or type is Tyvek®1443R.

Structurally, the disposable transport mat of the present invention operates under the same principles as the Slide-Mat® in that the tubular arranged interior and exterior panels are joined to one another with a padding such as spun polyester placed between the panels for padding. However, as noted above, the construction of the present invention is greatly simplified, as well as providing the exterior surface of the invention with a coating which assists in ensuring that the patient can be smoothly shifted from one location to another.

In a modification to the preferred embodiment of the present invention, a cover may used in conjunction with the disposable transport mat. The purpose of the cover is to protect the disposable transport mat from the elements (such as water, mud etc.) which therefore allows reuse of the disposable transport mat if desired. The cover is simply a tubular arranged piece of cloth or sheet material, and the disposable transport mat is inserted therein. During operation, the cover uniformly rolls with the transport mat. Optionally, a plurality of webbing strips may be sewn laterally across the cover wherein the webbing has multiple hand holes formed by protruding loops providing a means to grasp the loops to thereby lift the cover. In some circumstances where a back or neck injury is not serious and there is simply a need to lift the patient, then the cover with the webbing strips may be used to lift the patient. The webbing strips can also be used to pull the patient lying on the cover to better position the patient for displacement or lifting. For example, if it is necessary to slide the patient across an area, the loops may be grasped and then pulled to slide the mat.

Other features and advantages of the invention will become apparent from review of the following brief description of the drawings, taken in conjunction with the detailed description.

DETAILED DESCRIPTION OF THE DRAWINGS

Figure 1:
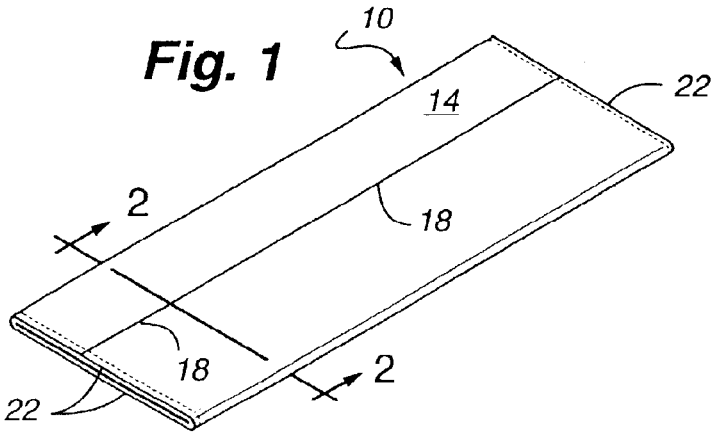
FIG. 1 is a perspective view of the disposable transport mat of the present invention.
Figure 2:
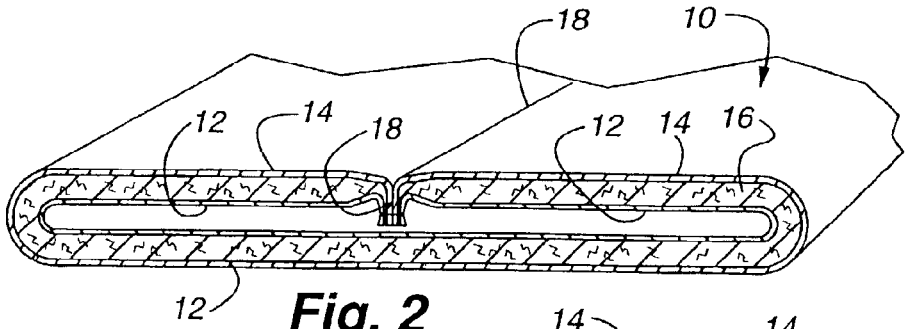
FIG. 2 is a cross-section taken along line 2—2 of FIG. 1 illustrating further details of the invention.
Figure 2A:
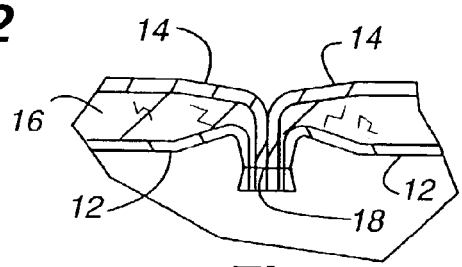
FIG. 2A is an enlarged fragmentary perspective view of the designated area in FIG. 2 illustrating one method by which the panels of the transport mat may be joined.

Referring to FIGS. 1 and 2, the disposable transport mat 10 is shown. The mat 10 includes an inner panel 12 which is joined at its longitudinal ends or edges thereby forming a continuous loop. The outer panel 14 surrounds the inner panel, and also forms a continuous loop by having its respective longitudinal ends or edges joined. Padding 16 may be formed with material such as spun polyester which is incorporated within a layer between the inner and outer panels. The longitudinal ends or edges of the panels are shown as being joined along a common seam or connection 18 which extends longitudinally in terms of the length of the transport mat. FIG. 2A illustrates one method by which the longitudinal edges of the panels may be joined which is simply by sewing together the abutting edges. Other methods can be used to join the panels such as by gluing, heat sealing, or ultrasonic sealing.

Also, a continuous seam 22 is formed at each end of the transport mat to join the adjacent transverse edges of the inner and outer panels thereby completing the sealed and looped or tubular configuration of the present invention.

Figure 3:
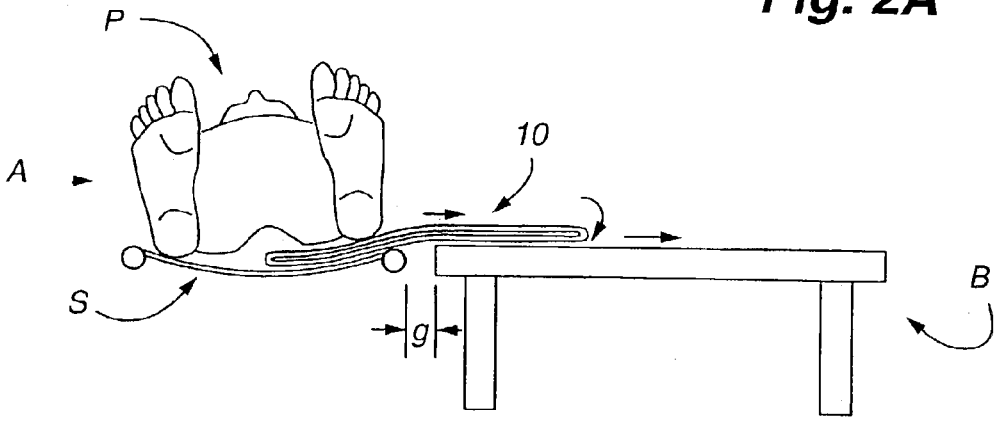
FIG. 3 illustrates a patient who is transported on a first surface such as a stretcher, and needs to be moved to another surface such as a hospital bed.
Figure 4:
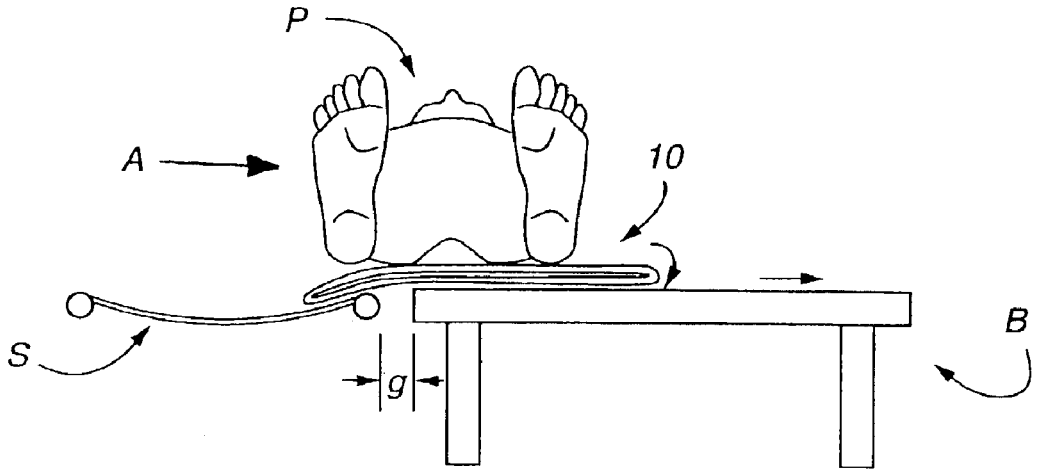
FIG. 4 is another figure showing the patient as the transport mat is rolled thereby moving the patient toward the desired location on the bed.
Figure 5:
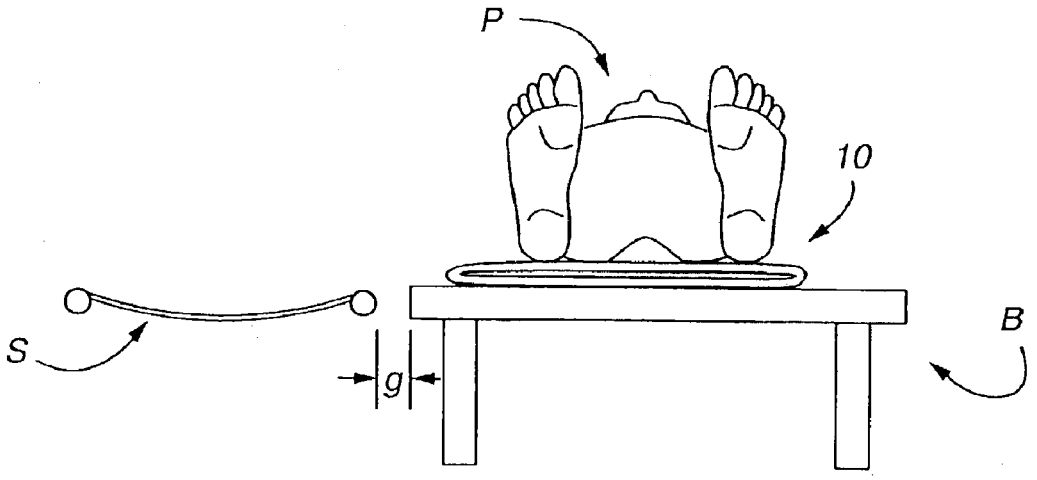
FIG. 5 shows the completed movement of the patient whereby the transport mat has assisted in complete transfer of the patient from the stretcher to the hospital bed.

FIG. 3 illustrates a patient P who may initially lie upon a stretcher S, and must be moved to a bed B. First, one longitudinal edge of the transport mat 10 is placed as far as possible under the patient's body without traumatizing the patient by unnecessary movement of the patient. It is desirable to have at least one leg, one hip, and one shoulder positioned over the longitudinal edge. The opposite longitudinal edge of the transport mat is placed on the surface to which the patient is to be transported. As shown in FIG. 4, the patient is transported from the position of FIG. 3 to the position of FIG. 4 by pushing on the patient's body in the direction as shown by arrow A, thereby causing the transport mat to roll. As shown in FIG. 5, displacement of the patient is complete once the patient has been pushed so that the patient's body is centered on the bed B. Of course, it is desirable to minimize the gap g between the abutting edges of the two surfaces to prevent the transport map from becoming entangled in the gap, as well as to prevent the patient from falling through the gap.

By use of a sticky or friction enhancing coating placed as a film over the outer surface of the transport mat, the patient will have better frictional engagement with respect to the outer panel thereby enhancing the rolling motion of the transport mat. Bunching of the transport mat particularly in the gap g can result if there is slippage between the patient and the outer panel. This bunching can also result in the requirement for additional force to be used to shift the patient. Thus, enhancing frictional engagement between the outer panel and patient helps avoid bunching. The coating applied to the outer panel may be a sprayable synthetic elastomer such as 3M® Super 77™. The slick inner surface of the transport mat ensures there is a minimum amount of friction as the inner surface contacts itself during the rolling motion.

By preparing the transport mat from Tyvek® material, for both the inner and outer panels, cost savings are achieved. Tyvek® is an extremely resilient material yet still has the qualities of a fabric so that it may be easily cut, sewn and glued. Because Tyvek® inherently has a slick surface, the inner surface of the transport mat does not have to be made of a different material than the outer surface. Thus, for most applications, it is not required to apply a silicone coating to the inner panel in order to allow the transport mat to easily roll during use. Nonetheless, a silicone coating may still be applied to the inner surface to further enhance the ability of the transport mat to roll during use.

Figure 6:
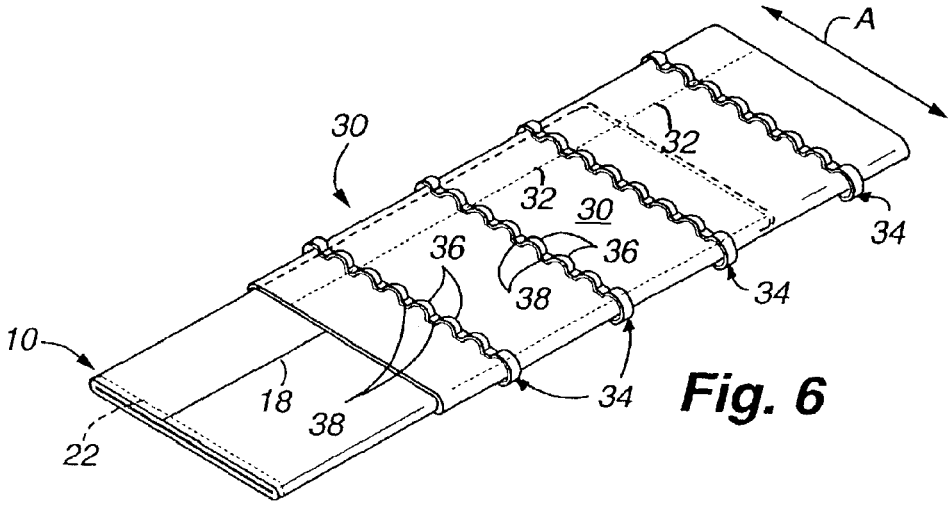
FIG. 6 is a perspective view of a modification to the preferred embodiment of the invention wherein a cover is used in conjunction with the disposable transport mat.
Figure 7:
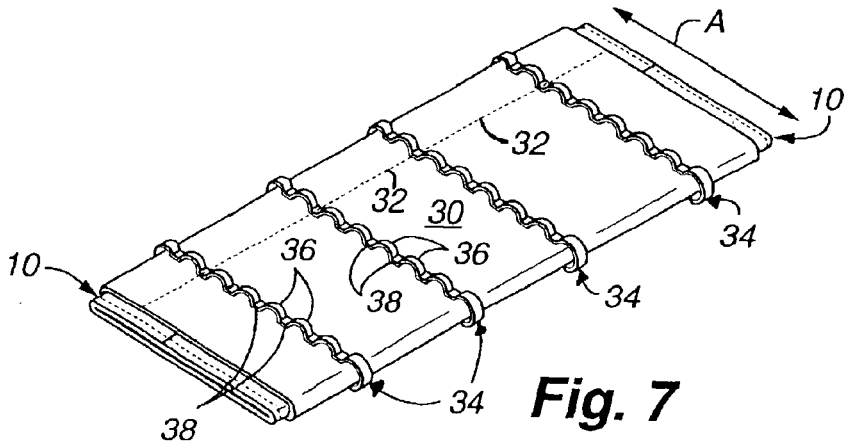
FIG. 7 is yet another perspective view of the cover used with the disposable mat illustrating a transport mat fully inserted within the cover.

Referring to FIG. 6, a modification to the preferred embodiment of the present invention is shown wherein a cover 30 may be used in combination with the transport mat 10. The cover 30 is simply a tubular-shaped piece of material made of a nylon or similar material. The material may be coated with an HT Teflon® and a water breathable coat to enhance water repelliency. The cover is joined along a single longitudinal seam 32. The seam may be sewn, heat sealed, or glued. One or more strips of webbing 34 may be sewn, glued, or heat sealed transversely along and longitudinally spaced along the cover. A plurality of hand holes 36 are defined by loops in the strips of webbing, and stitching or connection points 38 define those areas which attach to the cover 30. As shown in FIG. 6, the transport mat 10 is simply inserted within one of the open ends of the cover 30. As shown in FIG. 7, it is preferable that the transport mat have a length which is somewhat greater than the length of the cover 30. In those circumstances where it is first necessary to lift the patient uniformly, the required number of medical personnel may be enlisted to grasp the loops at the hand holes 36 and then uniformly lift the patient. For larger patients, it is of course preferably that there be at least two medical personnel on each side of the patient to provide the lifting motion. If it is first necessary to slide or displace the patient on the ground or on whatever surface the patient is lying, a user can either grasp the loops and pull the patient in the direction as indicated by arrows A or, the patient may be moved by pushing on the patient and utilizing the rolling feature of the disposable transport mat discussed above. It has been found that when the transport mat is made of Tyvek® and the cover is made of nylon, the cover will roll uniformly with the disposable transport mat without significant folding or bunching. Of course, use of a spray coating on the outer panel of the transport mat enhances adhesion/friction between the interior surface of the cover and the outer panel thereby further ensures that a smooth rolling motion is achieved in displacing the patient.

The present invention has been described with respect to a preferred embodiment. However, other changes and modifications may be made within the spirt and scope of the invention.

What is claimed is:

1. A disposable transport mat comprising:

an inner panel of material defined by a pair of opposing longitudinal and transverse edges, said pair of longitudinal edges being joined to form a continuous loop;

an outer panel defined by a pair of opposing longitudinal edges and transverse edges, said outer panel surrounding said inner panel, said outer panel having joined longitudinal edges forming a second continuous loop, said outer panel having its opposing transverse edges joined to corresponding opposing transverse edges of said inner panel;

said transport mat further including a thin film or layer applied to said outer panel to thereby enhance frictional engagement of said outer panel with a patient;

padding material disposed between said inner and outer panels; and wherein said inner and outer panels are made of spun bonded olefin.

2. A transport mat, as claimed in claim 1, wherein: said thin film or layer is applied by an adhesive spray.

3. A transport mat, as claimed in claim 1, wherein: said inner panel is coated with a thin film or layer of silicone.

4. A transport mat, as claimed in claim 1, wherein: said padding is made of spun polyester.

5. A transport mat, as claimed in claim 1, further including:

a cover having a tubular shape, said transport mat being inserted in said cover to substantially enclose said transport mat therein.

6. A disposable transport mat comprising:

an inner panel of material having joined longitudinal edges forming a continuous loop;

an outer panel surrounding said inner panel, both panels being made of a spun bonded olefin said outer panel having joined longitudinal edges forming a second continuous loop surrounding said loop of said inner panel, said outer panel having opposing transverse ends joined to corresponding opposing transverse ends of said inner panel;

padding material disposed between said inner and outer panels; and wherein said transport mat further includes a thin film or layer applied to said outer panel to thereby enhance frictional engagement of said outer panel with a patient.

7. A transport mat, as claimed in claim 6 wherein:

said thin film or layer is applied by an adhesive spray.

8. A transport mat, as claimed in claim 6 wherein:

said inner panel is coated with a thin film or layer of silicone.

9. A transport mat, as claimed in claim 6 wherein:

said padding is made of spun polyester.

10. A transport mat, as claimed in claim 6 further including:

a cover having a tubular shape, said transport mat being inserted in said cover to substantially enclose said transport mat therein.

11. A method of assembling a disposable transport mat, said method comprising the steps of;

providing a first panel of material;

providing a second panel of material joined to said first panel wherein the joined panels form a continuous loop including continuous inner and outer surfaces;

providing a layer of padding between said inner and outer surfaces;

coating the outer surface with a thin film or layer to enhance frictional engagement with a patient; and wherein said first and second panels are made of spun bonded olefin.

12. A method, as claimed in claim 9, wherein:

said panels are joined as by gluing.

13. A method, as claimed in claim 9, wherein:

said panels are joined as by sewing.

* * * * *